US006620267B1

(12) United States Patent
Guindon et al.

(10) Patent No.: US 6,620,267 B1
(45) Date of Patent: Sep. 16, 2003

(54) NON-TOXIC PRIMERS FOR SMALL CALIBER AMMUNITION

(75) Inventors: Louise Guindon, Vinnont Laval (CA); Daniel Lepage, Le Gardeur (CA); Jean-Pierre Drolet, Quebec (CA)

(73) Assignee: SNC Technologies Inc., Le Gardeur (CA)

( * ) Notice: Subject to any disclaimer, the term of this patent is extended or adjusted under 35 U.S.C. 154(b) by 0 days.

(21) Appl. No.: 09/623,593

(22) PCT Filed: Mar. 6, 1998

(86) PCT No.: PCT/CA98/00182

§ 371 (c)(1), (2), (4) Date: Dec. 19, 2000

(87) PCT Pub. No.: WO99/44968

PCT Pub. Date: Sep. 10, 1999

(51) Int. Cl.[7] ..... C06B 31/22; C06B 31/02
(52) U.S. Cl. ..... 149/63; 149/61
(58) Field of Search ..... 149/61, 94, 108.6, 149/63; 102/275.5, 275.6, 292, 202

(56) References Cited

U.S. PATENT DOCUMENTS

| | | | | | |
|---|---|---|---|---|---|
| 3,434,426 | A | * | 3/1969 | Dapper | 102/100 |
| 4,497,251 | A | * | 2/1985 | Rucker | 102/202.6 |
| H285 | H | * | 6/1987 | Downs et al. | 149/79 |
| 4,886,560 | A | * | 12/1989 | Cartwright | 149/12 |
| 5,125,684 | A | * | 6/1992 | Cartwright | 280/736 |
| 5,147,976 | A | * | 9/1992 | Laurensou et al. | 102/275.3 |
| 5,167,736 | A | * | 12/1992 | Mei et al. | 149/22 |
| 5,417,160 | A | * | 5/1995 | Mei et al. | 102/289 |
| 5,501,152 | A | * | 3/1996 | Zeuner et al. | 102/292 |
| 5,649,720 | A | * | 7/1997 | Rink et al. | 280/737 |

* cited by examiner

*Primary Examiner*—Michael J. Carone
*Assistant Examiner*—Aileen B. Felton
(74) *Attorney, Agent, or Firm*—David J. French

(57) ABSTRACT

A non-toxic primer composition for use in ammunition is provided with a hygroscopic oxidizer which is protected from absorption of water vapor by a water-barrier coating. A preferred oxidizer is potassium nitrate and a preferred coating is nitrocellulose.

5 Claims, No Drawings

NON-TOXIC PRIMERS FOR SMALL CALIBER AMMUNITION

FIELD OF THE INVENTION

This invention relates to non-toxic primers in the field of small caliber ammunition. In particular, it relates to non-toxic primers which can be used in all types of small arms ammunition, including reduced energy cartridges.

BACKGROUND OF THE INVENTION

Many publications and articles collected, for example, by the SAAMI (Sporting Arms and Ammunition Manufacturers' Institute) Environmental Committee clearly indicate the necessity for environment-friendly ("green") ammunition. The military is also moving in the same direction. For small caliber ammunition, the principal culprit in producing gaseous combustion products during firing that may be inhaled by the shooter (in the form of dust or oxides of toxic elements) is the primer. Small caliber ammunition is fired in large quantities both in indoor ranges for training or practice and outdoors for both of these reasons as well as for hunting, sporting events (trap shooting, biathlon, etc.) and military simulations.

Specifically, as detailed in the EPA (Environmental Protection Agency) list of toxic materials and the FBI (Federal Bureau of Investigation) list of toxic metals, there is a need to eliminate mercury, lead, barium, antimony, beryllium, cadmium, arsenic, chromium, selenium, tin and thallium from primer compositions. This means that long-standing chemically-stable, reliable non-corrosive primer compositions containing lead, barium, antimony or other metallic compounds are no longer acceptable from an environmental point of view. Unfortunately, primers containing such ingredients are still in wide use because suitable alternatives have not yet been found that eliminate all toxic materials as well as meeting ballistic reliability requirements and price realism.

There is much prior art. Going back to 1982, the following US patents are relevant: U.S. Pat. Nos. 4,363,679; 4,522,665; 4,566,921; 4,581,082; 4,608,102; 4,674,409; 4,675,059; 4,689,185; 4,963,201; 5,167,736; 5,353,707; 5,388,519, 5,417,160, 5,466,315 (Erickson) and U.S. Pat. No. 5,547,528 (Erickson). In addition there are European patent № 699 646 and French Patent № 9602359.

Many of these patents cite diazodinitrophenol (DDNP or dinol) as the primary explosive in combination with one or more oxidizers along with a variety of other ingredients necessary for the proper functioning of a primer. The oxidizers for primers cited in the prior art listed above include zinc peroxide, manganese dioxide, strontium peroxide, strontium nitrate, calcium carbonate, cupric oxide, ferric oxide, cesium nitrate, sodium oxalate, zirconium oxide and stannic oxide.

One oxidizer that does not appear prominently on this list is potassium nitrate ($KNO_3$). This lack of interest is undoubtedly because $KNO_3$ is hygroscopic (water solubility is 31.6 g/100 ml @ 20° C.). Any primer ingredient that has a tendency to attract or absorb water is not acceptable because of the negative effect on primer ignition, which manifests itself through misfires. The two Erickson patents listed above address the question of hygroscopicity, but neither uses $KNO_3$ as an ingredient.

U.S. Pat. No. 3,348,985 describes a gas-generating pyrotechnic composition for such uses as propellant charges for cartridges, missile propulsion, and to assist the take-off of military and commercial aircraft. This composition contains a small amount of $KNO_3$ (<9%) which is a component of the principal oxidizer in its as-purchased state and, as such, must be tolerated. U.S. Pat. No. 5,417,160 utilizes $KNO_3$ as an oxidizer in primers, but always in combination with calcium silicide.

One way to make $KNO_3$ immune to water (i.e., to "waterproof" it) is to coat it prior to incorporation into the mix with a thin layer of nitrocellulose (NC), amounting to about 1% by weight of the formulation, as described in this invention. There is prior art unrelated to primers which describes the use of NC in formulations also containing $KNO_3$, but not for the purposes of coating the $KNO_3$. For example, U.S. Pat. No. 5,125,684 describes a gas-generating propellant for use in a vehicle occupant restraint system which contains $KNO_3$ (>50% by weight) as an oxidizer and NC (20%) as a binder and principal combustion ingredient. U.S. Pat. No. 5,495,807 also deals with a gas-generating module for an airbag utilized in motor vehicles in which the gas-generating composition is arranged within a container in "the shape of a foil-like layer or coating, or alternatively consists of a granulate" with a first binder of NC (2% by weight) to give consistency to the mix during kneading prior to granulation.

An objective of this invention is to find a way to utilize a hygroscopic oxidizer $KNO_3$ as the primary and predominant oxidizer (>50% by weight of the oxidizer content) in a primer free of toxic materials in such a way that the ballistic performance of the primer will meet all performance specifications routinely required for small caliber ammunition. This will be done by demonstrating that $KNO_3$ can be utilized as a reliable primary oxidizer if suitably coated beforehand to eliminate its hygroscopic nature.

The invention in its general form will first be described, and then its implementation in terms of specific embodiments will be detailed hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention according to one aspect relies upon the presence in a primer composition of a hygroscopic oxidizer which is combined with waterproofing vapour barrier material to protect the oxidizer from undue absorption of atmospheric water vapour. A preferred oxidizer is potassium nitrate ($KNO_3$), which is coated with nitrocellulose, as a preferred coating material to protect the $KNO_3$ from its hygroscopic nature. Sufficient nitrocellulose coating is provided to ensure that the performance of $KNO_3$ as an oxidizer is not degraded by the presence of water that would otherwise be absorbed by the $KNO_3$ from the environment. Other oxidizers susceptible to moisture absorption, e.g. strontium nitrate $S_r(NO_3)_2$ can be similarly protected.

More preferably, the primer mix is free of toxic metals e.g. lead, barium, antimony. In a non-toxic primer DDNP may be employed as the primary explosive and optionally, PETN may be present as a secondary explosive. Tetrazene may be added to increase sensitivity to friction. Also optionally $ZnO.ZnO_2$ (containing at least 50–60% of $ZnO_2$) may be present as a secondary oxidizer, with $KNO_3$ predominating as the principal source of oxygen.

As further preferred constituents of the primer composition, silicon carbide (carborundum) may be present to increase sensitivity to friction (i.e. as a "frictionator") and aluminum powder may be used as the fuel.

More particularly, the preferred composition for the primer composition of the invention is shown in Table 1.

DESCRIPTION OF THE PREFERRED EMBODIMENT

The invention is directed towards a non-toxic primer composition containing DDNP as its primary explosive and $KNO_3$ as its primary oxidizer to be used in all types of small arms ammunition, including reduced energy cartridges as represented by U.S. Pat. No. 5,359,937, such cartridges containing only a very small propellant charge. Specifications for this primer composition were set as follows:

Action time <4 ms at −54° C. (as per NATO Specification D-74-305-A00/SF-001).

Particles generated by primer sufficiently "hot" to ignite very small propellant charges.

Sensitivity according to SAAMI specifications:

$$\bar{H}-2\sigma=1 \text{ inch and } \bar{H}+4\sigma=11 \text{ inches}$$

where $\bar{H}$ is the average height at which 50% misfires occur.

Sensitivity according to NATO specifications: (mass of ball=111.70 g)

$$\bar{H}-2\sigma>=75 \text{ mm } \bar{H}+5\sigma<=450 \text{ mm}$$

No loss in sensitivity over time.

Raw materials readily available at reasonable prices.

Cost of producing primer comparable to market price of competing primers.

A wet mix manufacturing process was adopted for safety reasons. The ingredients were judiciously selected with reference to the EPA and FBI lists previously mentioned as well as particulate and fume toxicity data published by such recognized authorities as OSHA (Office of Safety and Health Administration), ACGIH (American Conference of Government and Industrial Hygienists), NIOSH (National Institute for Occupational and Safety and Health) and COSHR (Canadian Occupational Safety and Health Regulations).

Thermal gravimetric analyses (TGA) and differential thermal analyses (DTA) were conducted to identify endothermic and exothermic reactions between potential oxidizers and fuels. The preferred mix was determined by using a ternary phase diagram where the weight concentration on each of the three axes represented the primary explosive, the primary oxidizer and the secondary oxidizer. Based on sensitivity requirements, an area within the triangle was identified for further iterations to optimize concentrations of fuel and friction agent, the other two principal ingredients in the composition.

DDNP was selected based on its favourable historic performance in other types of reduced-toxicity primers and because it is readily produced from available raw materials. PETN was added as a secondary explosive to generate more heat after ignition of the DDNP. Tetrazene was also added to increase sensitivity to friction.

Eight oxiders (carbonate and nitrate compounds along with a few metallic oxides) were assessed for sensitivity and other ballistic considerations. After taking cost into account, $KNO_3$ and the binary ceramic oxide compound $ZnO.ZnO_2$ (containing at least 50 to 60% of $ZnO_2$) were respectively selected as primary and secondary oxidizers. With respect to the prior art, it was necessary to make $KNO_3$ predominant over the secondary $ZnO.ZnO_2$ (i.e., $KNO_3$>50% by weight of the the total oxidizer content).

Prior to incorporation into the mix, the $KNO_3$ crystals had to be protected so as to negate their hygroscopic tendencies. To do this, a material that was insoluble in water was needed to coat the water-soluble $KNO_3$. There were several plastic candidates suitable for the job, but they would not have contributed to the combustion process, being essentially inert. It was thought, however, that NC would meet all three requirements: (1) water insolubility; (2) an active combustion ingredient; and (3) be susceptible to deposition on $KNO_3$ crystals. Subsequent testing proved this to be so. Primer mixes containing coated $KNO_3$ always met the drop test specifications whereas mixes containing uncoated $KNO_3$ yielded erratic drop text results that did not always meet the specification. The coating process is also applicable to other hygroscopic oxidizers, such as strontium nitrate, without known antagonistic reactions.

The secondary oxidizer selected was the binary ceramic oxide compound $ZnO.ZnO_2$ containing 50 to 60% of zinc peroxide ($ZnO_2$). Three fuels (titanium, zirconium and aluminum) were assessed and the best was found to be aluminum powder due to its favourable performance/price ratio. Silicon carbide (carborundum) was added to the composition to further increase sensitivity to friction and to provide hot particles to ease ignition of percussion primers. It was selected from a group of eleven candidates that were assessed. Finally, a binder was added to facilitate the compaction of the priming mix into primer cups and to prevent powder loss during subsequent handling.

Based on this approach, the preferred ingredients for a priming composition which meets the objectives of this invention are shown in Table 1. Various ratios of the ingredients, as indicated in the column of Table 1 giving weight ranges, can be used depending on the desired characteristics of the final product. An optimum composition, as detailed in the preferred weight column of Table 1, was determined based on sensitivity to impact and friction tests, sensitivity to drop tests, the quantity of gas generated after ignition in a closed bomb, ease of control of charge weight in primer cups, and ballistic performance when fired in reduced energy cartridges as represented by U.S. Pat. No. 5,359,937.

As already stated above, the preferred primer composition is shown in Table 1. The DDNP used had a molecular weight of 210 g, a density of 1.63 g/cc, and an ignition temperature of 200° C. It's particle size distribution was approximately 80%>50 $\mu$m and 20%<50 $\mu$m. The PETN used met MIL-P-387 specifications and had a particle size of about 100 $\mu$m. The tetrazrene was manufactured according to MIL-T-46938.

$KNO_3$ powder (Class 2, MIL-P-156) was added to a previously-prepared 3% solution of NC in acetone and the resulting slurry was mixed in an appropriate blender before being dried at 60° C. for 24 h and then ground to a particle size of about 100 $\mu$m. This grinding process may expose portions of the $KNO_3$ to the atmosphere, but a sufficient amount of $KNO_3$ remains either fully or partially coated to provide the necessary resistance to moisture absorption. "Coating" as used herein reflects this degree of coverage of the oxidizer as described.

The $ZnO.ZnO_2$ (at least 50 to 60% $ZnO_2$) had a particle size <45 $\mu$m, the aluminum powder (<45 $\mu$m) was according to MIL-A-512A and the SiC was of a commercial grade (approx 100 $\mu$m). The binder was an acrylic resin.

To prepare the mix, the explosive ingredients were mixed together with the DDNP initially containing 30 to 40% water, the PETN containing 15% water, and the tetrazene 20 to 30% water. Next, the non-explosive ingredients, including $KNO_3$ previously coated with NC, were mixed dry separately. The dry non-explosive mixture was then added to the wet mixture of explosive ingredients and thoroughly mixed. The water content was maintained at 15%, by adding additional water if necessary. Finally, the binder was added and a final mixing performed. The finished mix was stored at 4° C. prior to use.

During loading, the mix was pressed through a standard perforated primer plate to form pellets of the desired size for loading into primer cups. Since DDNP is much lighter than the lead styphnate usually used as the primary explosive in conventional primers, the nominal weight of the charge was reduced by about 30%. The resultant charge weight was 12.6 g.

After charging the cups, a lacquered paper was tamped onto the wet charge, and the charge was compacted. A layer of sealing lacquer was placed on top of the foil before drying the primers at 50° C. Following drying, the primers were inserted into cartridge cases in preparation for ballistic evaluation. In all respects, the method of preparing the primers followed general well-known procedures in the field. Physical dimensions of primer cups and anvils were closely controlled as were the overall height of assembled primers and the depth of insertion into primer pockets.

Primers containing the non-toxic mix were subjected to the conventional SAAMI drop test using a 1.94 oz (55 g) weight dropped onto a rifle firing pin. Run-down tests were conducted at heights varying from 1 to 11 inches (25 to 280 mm) in order to obtain the average drop height-H at which 50% of the primers fired and 50% failed to fire. Over 50 such tests were conducted.

Sensitivity to friction and impact was determined by dropping a 1.0 kg weight along a 45° inclined plane onto either a dry or wet sample located at the bottom of the plane on a rough surface. The vertical height of the plane was 210 cm for the wet sample and 10 cm for the dry sample. The acceptance criterion for both was no detonation and no sparks when the weight impacted the samples.

Finally, standard function and casualty tests were conducted using reduced-energy cartridges as represented by U.S. Pat. No. 5,359,937 in many pistols and submachine-guns modified to fire this type of ammunition, as well as in many revolvers. With both types of weapons, the action time was measured to detect if there were any problems related to slow ignition or to hangfires. The pistols included: the SIG Sauer P226, P227 and P229 (both 9 mm and ·40SW); the H&K MP5A2/A3 and MP5SD; the Beretta 92F and 96D; the Browning HP; the Smith & Wesson 5904, 5946 and 4006; the Glock 17; and the Colt M16A2 and M4. The revolvers included: Smith & Wesson Models 10, 13, 14 and 64; Ruger Models SP-100 and SP-101; and Tarus Models 65 and 82. Firings were also conducted in the Mosberg 500 Remington 870 shotguns.

The results from all these tests are given in Table 2. As can be seen, they clearly show that the non-toxic primer described herein is satisfactory for its intended purpose. The invention being thus described, it is obvious that the non-toxic primer formulation can be varied in many ways. For example, by using a different particle size for the friction agent (60 $\mu$m instead of 100 $\mu$m) there will be a slight modification to the drop test sensitivity, although always staying within acceptable limits. Such variations in the ingredients are not to be regarded as a departure from the spirit and scope of the invention and all such variations are intended to be included herein.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

TABLE 1

Range and Preferred Levels of Ingredients for Non-Toxic Primers

| Formulation | Ingredient | % Weight (Range) | % Weight (Preferred) |
|---|---|---|---|
| Primary explosive | DDNP | 20–30 | 30 |
| Secondary explosive | PETN | 2–4 | 2 |
| Ternary explosive | Tetrazene | 7–12 | 8 |
| Primary oxidizer (coated with NC) | $KNO_3$ | 25–30 | 26 |
| Coating on $KNO_3$ | Nitrocellulose | 0.5–1.5 | 1 |
| Secondary oxidizer | $ZnO.ZnO_2$ | 15–20 | 17 |
| Friction agent | SiC | 5–7 | 7 |
| Fuel | Aluminum | 5–10 | 8 |
| Binder | Acrylic resin | 1 | 1 |

TABLE 2

Summary of Test Results

| Test | Results |
|---|---|
| Friction and Impact Test (Wet) | No detonation; no sparks |
| Friction and Impact Test (Dry) | No detonation; no sparks |
| Drop Tests (SAAMI) | $\overline{H} - 2\sigma = 3.96$ inches (100 mm)<br>$\overline{H} + 4\sigma = 8.22$ inches (208 mm) |
| Action Time at −54° C. | 1.5 ms |
| Function and Casualty | All weapons OK |

The embodiments of the invention in which an exclusive property or privilege is claimed are defined as follows:

1. A primer composition comprising $KNO_3$ as the predominant hygroscopic oxidizer therein which is combined with nitrocellulose as a coating to provide a waterproofing vapour barrier material to protect the $KNO_3$ oxidizer from undue absorption of water vapour.

2. A primer composition as in claim 1 comprising the following components by percentage weight:

| Component | % Weight |
|---|---|
| DDNP | 20–30 |
| PETN | 2–4 |
| Tetrazene | 7–12 |
| $KNO_2$ | 25–30 |
| Nitrocellulose | 0.5–1.5 |
| $ZnO.ZnO_2$ | 15–20 |
| Frictionator | an effective amount as a frictionator |
| Aluminum | 5–10 |
| Resinous binder | an effective amount as a binder. |

3. A primer composition as in claims 1 or 2 comprising $KNO_3$ predominating as the principal source of oxygen and $ZnO.ZnO_2$ (containing at least 50–60% of $ZnO_2$) as secondary oxidizer.

4. A primer composition as in claims 1, 2 or 3 that is free of toxic metals selected from the group consisting of: lead, barium, antimony.

5. A primer composition comprising the following components in substantially the percent weights as indicated:

| | |
|---|---|
| DDNP | 30 |
| PETN | 2 |
| Tetrazene | 8 |
| $KNO_3$ | 26 |

-continued

| | |
|---|---|
| Nitrocellulose | 1 |
| $ZnO.ZnO_2$ | 17 |
| SiC | 7 |
| Aluminum | 8 |
| Acrylic resin | 1. |

* * * * *